US006450893B1

(12) United States Patent
Primiano et al.

(10) Patent No.: US 6,450,893 B1
(45) Date of Patent: Sep. 17, 2002

(54) APPARATUS FOR PROVIDING A LASER ALIGNMENT GOLF TRAINING AID

(75) Inventors: Vincent Primiano, Rockville Centre; Alfred H. Ganser, Great River, both of NY (US)

(73) Assignee: Sports Tech Group, Inc., Rockville Centre, NY (US)

( * ) Notice: Subject to any disclaimer, the term of this patent is extended or adjusted under 35 U.S.C. 154(b) by 0 days.

(21) Appl. No.: 09/796,737

(22) Filed: Mar. 1, 2001

(51) Int. Cl.[7] ..... A63B 69/36
(52) U.S. Cl. ..... 473/220; 473/409
(58) Field of Search ..... 473/220, 223, 473/226, 261, 257, 262, 265, 268, 278

(56) References Cited

U.S. PATENT DOCUMENTS 2,776,836 A * 1/1957 Zadina
2,995,376 A * 8/1961 Leo
5,143,376 A * 9/1992 Johnson
5,207,429 A * 5/1993 Walmsley et al.
5,882,266 A * 3/1999 Schaum
5,964,668 A * 10/1999 Tai et al.
6,149,537 A * 11/2000 Hooker

* cited by examiner

*Primary Examiner*—Paul T. Sewell
*Assistant Examiner*—Nini Legesse
(74) *Attorney, Agent, or Firm*—Roberts, Abokhair & Mardula, L.L.C.

(57) ABSTRACT

An apparatus for providing a laser alignment golf training aid uses a single-pivot mounting clamp for easy installation and improved accuracy. A support bar is pivotally mounted directly to the single-pivot mounting clamp and a unitary element is used to clamp a laser aiming device to the support bar. There are no interfaces or fasteners between the support bar interface and the aiming device interface of the unitary element to further eliminate sources of inaccuracy. The device uses a hollow support bar and alloy fastening elements to reduce weight.

7 Claims, 3 Drawing Sheets

APPARATUS FOR PROVIDING A LASER ALIGNMENT GOLF TRAINING AID

FIELD OF THE INVENTION

The present invention is drawn to an apparatus for providing a laser alignment golf training aid. More particularly, it is drawn to laser alignment golf training aid that can be easily installed and aligned on a variety of putters or other clubs to provide club alignment feedback. The use of the golf training aid of the present invention promotes keeping the club face square to the ball and target line regardless of the putting distance. The design and assembly method provides a more accurate and affordable device.

BACKGROUND OF THE INVENTION

Numerous golf putting aids using laser devices have been developed in recent years.

U.S. Pat. No. 5,465,972 discloses a putting aid that uses a laser device mounted on a lower portion of a putter to point to a target so as to align a putt. The laser device is mounted above the putter sweet spot perpendicular to the club head's face on a rear bracket that is in parallel to the putter head's longitudinal axis. The rear bracket is attached to the putter's shaft through a series of brackets. The laser device is "centered" over the sweet spot by sliding the laser along the rear bracket. Other adjustments allow minor rotation of the laser beam so the laser beam may be projected to a target. Mounting the device at different heights on the putter shaft provides for larger vertical adjustments. The golfer practices putting by aligning the putter so the laser beam to appears at the target. The golfer modifies his stroke to compensate for deviations from the projected path and actual path of the golf ball. The primary disadvantages of this design is that alignment over the sweet spot of the club must be "eyeballed," multiple fasteners must be operated to install and remove the device, and the extensive cantilevers of the device are subject to vibration.

U.S. Pat. No. 5,213,331 discloses a laser device built into the putter head or assembled to the putter head by use of a kit. The laser device is mounted on top of the head so that the laser beam will clear the golf ball and describe a sighting line to the target. The laser is vertically adjustable so that the position the sighting line touches the putting surface will vary. The golfer uses the sighting line described by the laser to practice his putting stroke. The primary disadvantage of this design is that it is permanently mounted to the club, thereby requiring the purchase of a separate club and eliminating the use of the practice club for tournament play. The inability to remove the device from a club also subjects the unit to damage if stored in a golf bag.

U.S. Pat. No. 5,882,266 discloses a laser putting aid that is mounted on the putter shaft pointing downward. A hinged mirror mounted near the bottom of the club shaft and above the club head may be adjusted to reflect the laser beam on a horizontal path. The laser beam projects to a target on a putting practice surface above the ball's target. This allows the golfer to learn alignment positioning in a practice environment. U.S. Pat. No. 5,882,266 also discloses that the hinged mirror can be positioned vertically so as not to reflect the laser. The laser beam then traces the golf club head's path during a practice swing through impact with the golf ball thus reinforcing hitting the ball with the putter face's sweet spot. The primary disadvantage of this design is that it positions the laser a fixed distance from the shaft and does not necessarily align it with the sweet spot.

U.S. Pat. No. 5,472,204 discloses a radiant energy generator (preferred embodiment being a laser) mounted at the upper end of a putter shaft and rotated to mark multiple interim targets, one at a time, between the putter face and the target hole. This design requires that the putter be held in place as the golfer rotates the light generator through multiple, discrete positions. Putter blade alignment is adjusted so that spots sighted between the putter face and the hole appear to be correct. The primary disadvantages of this design are the complexity of the adjustments and that the upper location of the laser provides less putting line feedback than a lower-mounted location during a putting stroke.

U.S. Pat. No. 5,725,440 discloses a laser guided golf club putter where the laser is mounted inside the club shaft near the top of the club. The light source is pointed down where the laser beam is reflected from a mirror mounted near the bottom of the shaft and exits an aperture. The angle of the mirror and hence the location the laser strikes the putting surface is adjustable. U.S. Pat. No. 5,725,440 discloses a second embodiment where there is a splitting of the light source and the light source is emitted from apertures near the bottom of the shaft, one beam at approximately in a horizontal plane, a second beam pointed downward behind the ball. The primary disadvantage of this design is that it is permanently mounted inside the club, thereby requiring the purchase of a separate club and eliminating the use of the practice club for tournament play.

U.S. Pat. No. 5,725,439 discloses mounting a bracket on the face of a golf club by using a magnet. A laser aiming device is mounted on the bracket and positioned above the face, perpendicular to the face plane. Lateral adjustment rings allow the laser aperture to be position over the putter face's center (i.e., the sweet spot). The laser head is rotated so that the laser beam points to a desired target that may be the ball, the hole or some spot in between. The primary disadvantage of this design is the inability to easily switch between clubs, such as when trying out a new putter prior to purchase, due to the need for a permanent mounting bracket on the face of the club.

U.S. Pat. No. 5,788,588 discloses a 'Putter training method' that uses a laser device to reinforce correct swing mechanics. The laser is mounted high on the putter shaft pointed downward so that a laser spot is viewed on the floor between the golfer's feet and the heel of the putter. As the golfer swings the club, a laser trace is projected on the floor. The objective is to maintain laser line traces that are parallel to the club head through repetitive swings, thus reinforcing proper stroke mechanics. Alternative disclosures position and align the laser to describe different laser beam paths thus reinforcing swing mechanics relating to impacting a golf ball with the sweet spot of the putter. Although useful for improving swing mechanics, it is less useful for promoting keeping the club face square to the ball and target line regardless of the putting distance.

U.S. Pat. No. 6,004,230 to Hooker, 'Methods for training golf putting skills,' discloses methods of training putting mechanics using a laser light source as feedback. Much of what is disclosed is found in U.S. Pat. No. 5,788,588. The method of positioning the laser over the sweet spot and requiring the golfer to maintain the laser spot behind the golf ball so that impact of the ball occurs with the sweet spot is emphasized. No feedback with respect to distant targets is provided.

U.S. Pat. No. 6,149,531 to Hooker, 'Method for training golf putting skills,' discloses much of what is disclosed in U.S. Pat. No. 6,004,230 with the added emphasis of keeping the laser spot on the golf ball after impact and until the ball reaches the target. This method reinforces the mechanics of maintaining follow through toward the target. No target alignment training is provided.

U.S. Pat. No. 6,149,537 to Hooker, 'Methods for training golf putting skills,' discloses much of what is disclosed in U.S. Pat. No. 6,149,531. The emphasis is in the method where the practicing golfer maintains a straight laser line on follow through. The primary disadvantage of this design and its associated methods is that it is limited to a body alignment and follow-through tool, without providing target aim feedback U.S. Pat. No. 5,848,944 discloses a putter training method that uses a laser mounted on the putter shaft to trace the paths of practice putting swings. The training objective is to maintain the laser spots in a straight path parallel to a guide that has been placed on the putting surface. The exercise is repetitively done to reinforce the mechanics of a straight swing. The primary disadvantages of this design is that it has limited sweet spot alignment capabilities and only provides swing line feedback, not target aim feedback.

What would be truly useful is a laser alignment golf training aid that (i) provides accurate target aim feedback; (ii) attaches and detatches easily from a club; (iii) requires no permanent modifications to the club; and (iv) aligns with the sweet spot quickly and accurately.

BRIEF SUMMARY OF THE INVENTION

The present invention provides a golf training aid that incorporates laser alignment. It can be easily installed and aligned on a variety of putters or other clubs to provide club alignment feedback. The use of the golf training aid of the present invention promotes keeping the club face square to the ball and target line regardless of the putting distance. The assembly method provides a more accurate and affordable device.

It is an object of the invention to provide a golf training aid that is easy to mount and accurately align on a golf club.

It is another object of the invention provide a golf training aid that provides improved target alignment feedback due improved alignment positioning and reduced vibration in use.

It is yet another object of the invention to provide method of making a golf alignment aid that improves its accuracy in use.

DETAILED DESCRIPTION OF THE INVENTION

Figure 1:
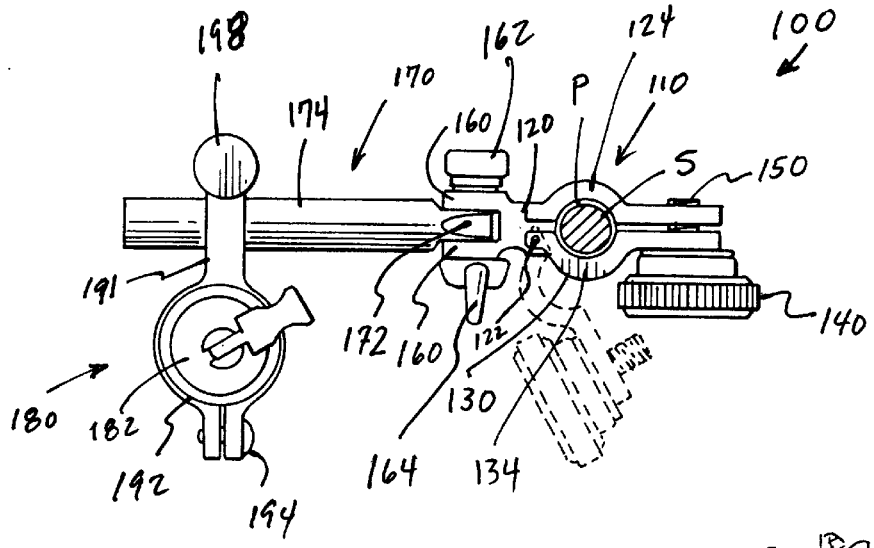
FIG. 1 illustrates a top view of the present invention in preparation for alignment.
Figure 2:
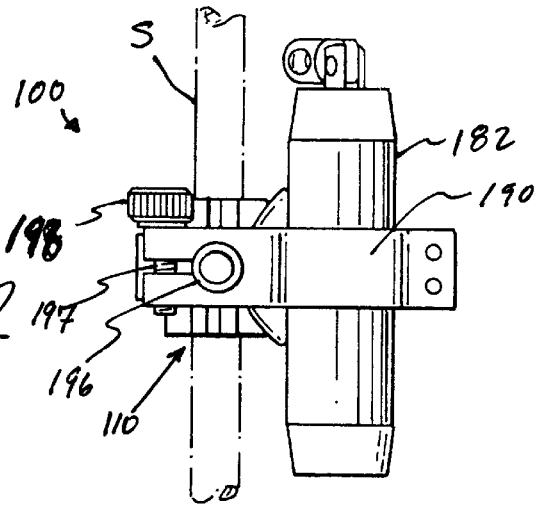
FIG. 2 illustrates a side view of the present invention in preparation for alignment.
Figure 3:
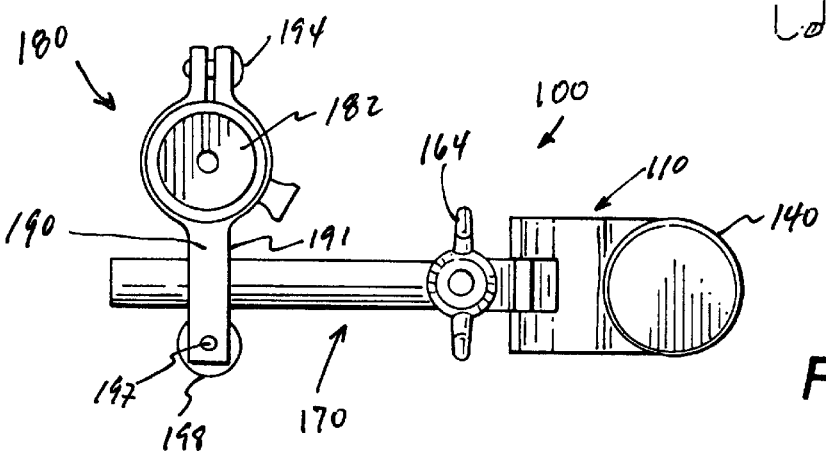
FIG. 3 illustrates a front view of the present invention in a use position.

As illustrated in FIGS. 1–3, the training aid device 100 of the present invention includes a clamp 110 that is dimensioned to attached to the lower portion of a golf club shaft S.

The clamp 110 can be manufactured from lightweight alloy in various sizes to fit different shaft diameters and can include a split plastic bushing (i.e., a plastic sleeve or shim) P to protect the shaft finish and adjust for slight differences in shaft diameters. It is also possible to attach an equivalent structure to the clamp 110 itself. The clamp 110 is of a single-pivot type. In a preferred embodiment, the clamp 110 has main section 120 and a single pivoting section 130 having a pivot means therebetween, such as a hinge pivot 122. The pivoting section 130 engages the pivot 122 at a first end 132 and further includes a shaft engaging mid-portion 134 and means for securing the pivoting section 130 at the second end 136.

The main section 120 of the clamp 110 includes a shaft-engaging mid-portion 124. A preferred means for securing the pivoting portion 130 of the clamp 110 to the main portion 120 is by use of a threaded fastener 150 that engages an internally-threaded hole (not shown) in said main section 120. The threaded fastener is secured with a hand-operated means, such as a large knurled alloy knob 140. The knob 140 or other means should have an effective diameter that is preferably greater than 15 mm to enable enough torque to provide sufficient hand-tightening of the clamp 110. The use of the single-pivot clamp allows for easy installation and removal of the training aid from a club yet provides a secure attachment so as to reduce vibration that would be noticeable when using the device.

In addition to pivoting section 130, the clamp 110 includes at least one flange member 160 integrated with the main portion 120. The at least one flange member 160 extends in a plane parallel to the pivot 122. The at least one flange member 160 includes a means, such as a hole or threaded hole (not shown) to accept a threaded fastener used to pivotally secure a support shaft 170.

In a preferred embodiment, the main portion 120 of the clamp 110 includes a pair of spaced flanges 160 having aligned holes. The support shaft 170 includes a flange 172 dimensioned to fit between the spaced flanges 160. The shaft flange 172 includes a hole (not shown) for aligning with the holes in that spaced flanges 160 so as to accept a threaded fastener to form a pivoting connection for the support shaft 170 relative to the clamp 110.

The threaded fastener includes at last one hand-engagable member, such as a knurled knob 162 or a wing nut 164 to allow the position of the support shaft 170 to be adjusted by hand. Although illustrated with both, it is clear that knob 162 could be replaced with other means, such as a locking fastener head and that the wing-nut 164 could be replaced with other means, such as a threaded hole in one clamp flange 160, without departing from the scope of the present invention.

The support shaft 170 is preferably steel or a lightweight alloy and includes the above-mentioned flange portion 172 and a sufficient length of a circular cross-section portion 174 for mounting an aiming assembly 180. A significant portion of this circular cross-section portion 174 is hollow for weight savings.

The aiming assembly 180 includes a clamping assembly 190 and an aiming device 182 for projecting an optical aiming beam. Although a laser is preferred as the aiming device 182, it is also possible to use focused visible and infrared light beams (although infrared beam would require a detector at the target).

The clamping assembly 190 preferably includes a body 191 formed from a single piece of lightweight alloy as a unitary element and includes an aiming device retention clamp 192 and securing means 194 for securing the aiming device 182 and a support bar clamp 196 and hand-operable fastener 197 with a knurled knob 198 for adjustably securing the aiming assembly 180 to the support shaft 170. The respective clamps are perpendicular to each other and securing means for said perpendicular clamps are preferably attached outboard of said support bar and said optical beam-emitting device so as to form a rigid structure that minimizes vibrations.

Figure 4:
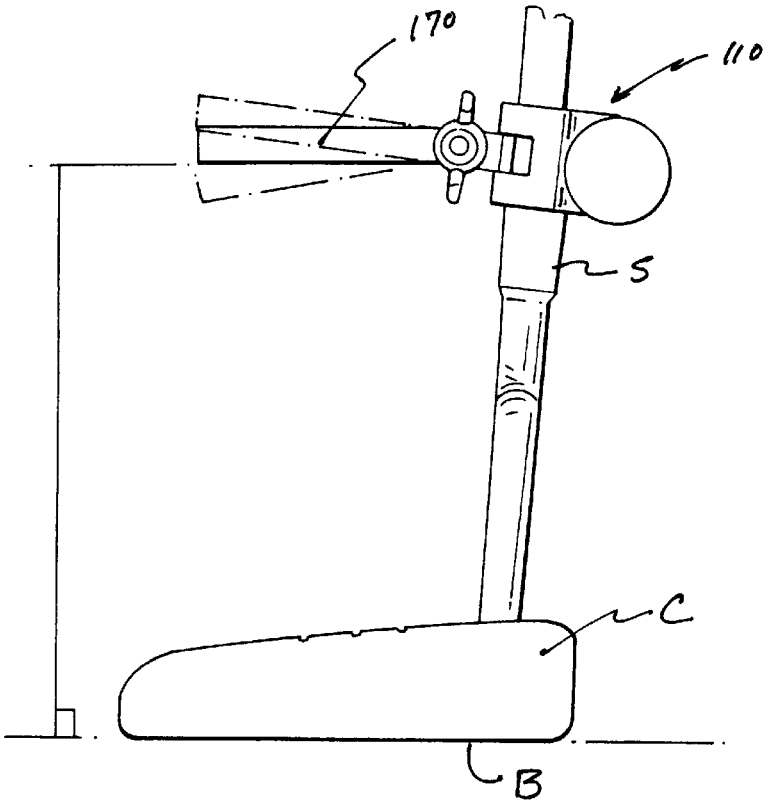
FIG. 4 illustrates a front view of the present invention in preparation for alignment of the support bar.
Figure 5:
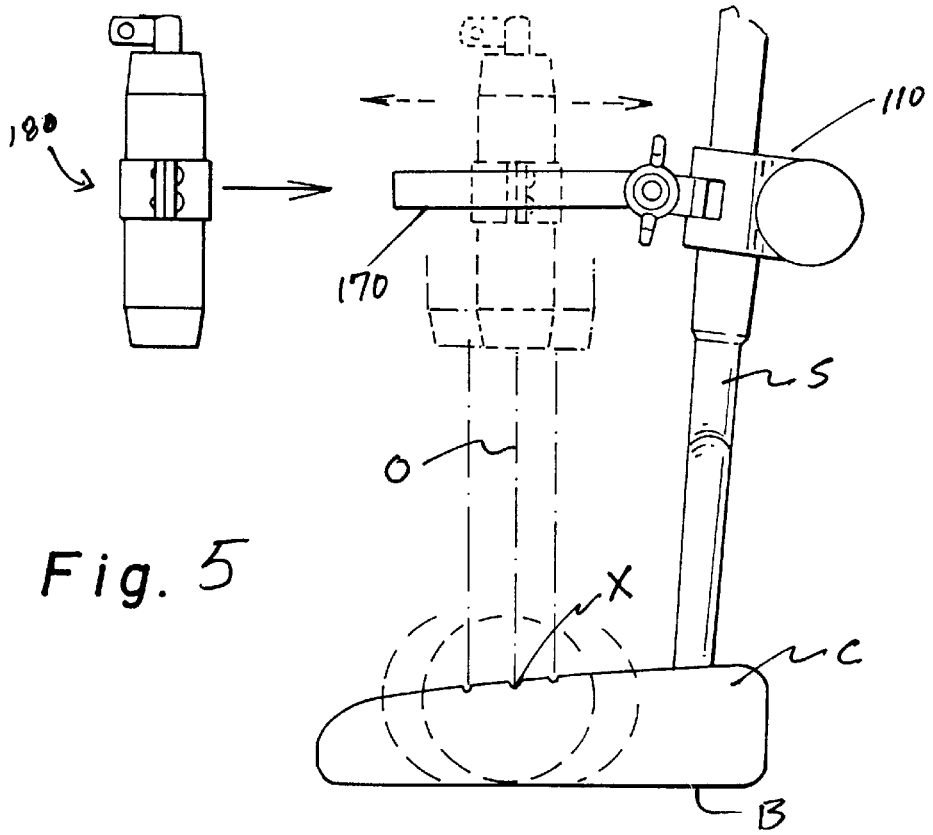
FIG. 5 illustrates a front view of the present invention in preparation for alignment relative to the sweet spot of a golf club.

To use the device of the present invention, the clamp 110 is opened (see FIG. 1) and secured to a lower portion of a golf club shaft S, as illustrated in FIGS. 4 and 5. The support shaft 170 is aligned to be parallel with the club face C and sole B (so as to be parallel with the putting surface), as illustrated in FIG. 4.

Figure 6:
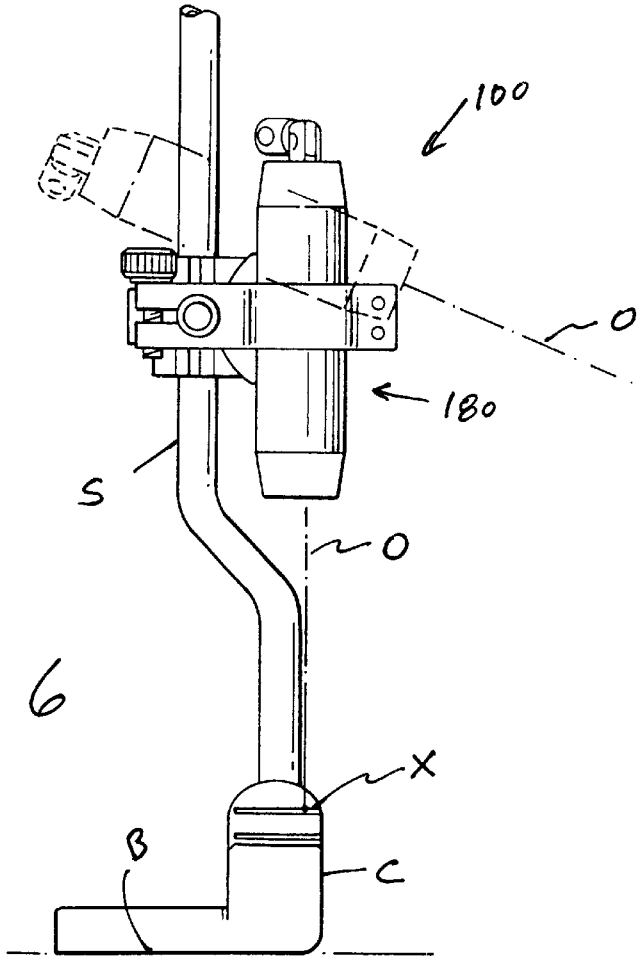
FIG. 6 illustrates a side view of the present invention showing the transition between an alignment position and a target aiming position.

The aiming assembly 180 is then positioned on the support bar 170 at a location in line with the sweet spot X of the club face C by turning on the optical beam O and aligning the assembly 180 so as to have the beam O point at the sweet spot or a marker representative thereof, as illustrated in FIGS. 5 and 6.

Figure 7:
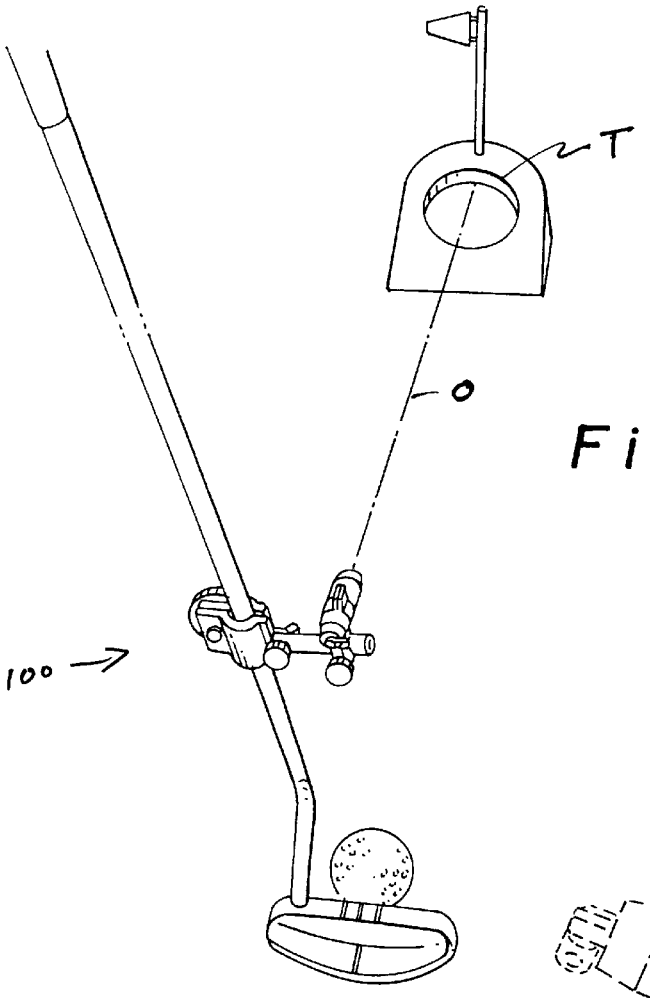
FIG. 7 illustrates use of the present invention for target alignment feedback.

As illustrated in FIGS. 6 and 7, the aiming assembly 180 is then rotated so as to aim the beam O at a desired golf target T. The user can then practice golf shots, such as putting or chipping, and receive club alignment feedback via the emitted beam O.

The fabrication of the device in accordance with the disclosed design reduces "slop" and vibration to produce a more accurate device by eliminating major sources of these problems. The use of a single-pivot clamp with an integral pair of flanges to attach the support bar eliminates the error caused by pivot and attachment tolerances. The positioning and assembly of the securing means for said perpendicular clamps of the aiming assembly in an outboard location (eliminating any fasteners or interfaces between said support bar and said optical beam-emitting device) forms a rigid structure that minimizes vibrations. The hollow support bar and alloy fastener knobs reduce the weight and vibration associated therewith.

In a preferred embodiment, the weight of the training aid device is less than three ounces so as to minimize vibration of the device and minimize the influence/feel of the device on the user's golf stroke. To minimize the weight, hardware such as the knurled knobs should preferably be formed from lightweight allows such as aluminum. A preferred aiming device is a batterypowered Class IIIA laser device that conforms to 21 CFR 1040.10 and 1040.11.

Although disclosed with respect to a preferred embodiment, various modifications can be made without departing from the scope of the present invention, which is limited only by the following claims.

What is claimed is:

1. A golf training aid, comprising:

a single-hinged mounting clamp dimensioned to engage a lower portion of a golf club shaft, said clamp including:

a main portion having a means to secure a pivot at a first end, a golf club shaft-engaging mid-portion, a fastener-engaging portion at a second end, and at least one integral flange member in a plane parallel with said pivot and incorporating at least one aligned hole; and a pivoting portion having a means to engage said pivot at a first end, a golf club shaft-engaging mid-portion, and a fastener-engaging portion at a second end;

a mounting clamp fastener comprising a portion engaging said fastener-engaging portions of said main portion and said pivoting portion and a first hand-operable securing means;

a cylindrical support bar having a flange with an aligned hole for engaging said at least one integral flange member;

a support bar fastener comprising a portion engaging said at least one integral flange member and said support bar flange, said support bar fastener further comprising at least one second hand-operable securing means; and an aiming assembly, said aiming assembly including:

an optical beam-emitting device; and a means for mounting said optical beam-emitting device to said support bar in a plane perpendicular to said support bar, said means for mounting including a support bar-engaging clamp and a third hand-operable securing means.

2. The golf training aid of claim 1, wherein said support bar is hollow.

3. The golf training aid of claim 1 wherein said optical beam-emitting device is selected from the group consisting of visible lasers, focused visible light sources, and focused infrared light sources.

4. The golf training aid of claim 1 wherein said means for mounting said optical beam-emitting device to said support bar is formed from a single piece of alloy that includes a pair of perpendicular clamps for respectively engaging said optical beam-emitting device and said support bar, wherein respective securing means for said pair of perpendicular clamps are attached outboard of said support bar and said optical beam-emitting device.

5. The golf training aid of claim 2 wherein a weight of said training aid is less than three ounces.

6. The golf training aid of claim 1, further comprising a split plastic bushing for placement between said mounting clamp and said shaft.

7. The golf training aid of claim 1 wherein said first hand-operable securing means is lightweight alloy and has an effective diameter of at least 15 mm.

* * * * *